US005235764A

United States Patent [19]

Perazzi

[11] Patent Number: 5,235,764

[45] Date of Patent: Aug. 17, 1993

[54] BUTT FOR RIFLES WITH CHEEKPIECE WITH ADJUSTABLE POSITION

[75] Inventor: Daniele Perazzi, Botticino Mattina, Italy

[73] Assignee: Manifattura Armi Perazzi S.p.A., Brescia, Italy

[21] Appl. No.: 847,162

[22] Filed: Mar. 5, 1992

[30] Foreign Application Priority Data

Nov. 19, 1991 [IT] Italy ..... BS91 A000127

[51] Int. Cl.[5] ..... F41C 23/14

[52] U.S. Cl. ..... 42/73; 42/1.01

[58] Field of Search ..... 42/73, 71.01, 1.01

[56] References Cited

U.S. PATENT DOCUMENTS

| | | | |
|---|---|---|---|
| 3,710,496 | 1/1973 | Packmayr et al. | 42/73 |
| 4,589,219 | 5/1986 | Milliman | 42/73 |
| 5,031,348 | 7/1991 | Cavey | 42/73 |

FOREIGN PATENT DOCUMENTS

| | | | |
|---|---|---|---|
| 114228 | 11/1941 | Australia | 42/71.01 |
| 224652 | 7/1985 | Fed. Rep. of Germany | 42/73 |
| 376364 | 11/1939 | Italy | 42/73 |
| 100836 | 9/1962 | Norway | 42/71.01 |

*Primary Examiner*—Stephen M. Johnson

*Attorney, Agent, or Firm*—Mc Glew and Tuttle

[57] ABSTRACT

A butt for rifles having a cheekpiece that can be adjusted both vertically and laterally.

6 Claims, 2 Drawing Sheets

BUTT FOR RIFLES WITH CHEEKPIECE WITH ADJUSTABLE POSITION

FIELD OF THE INVENTION

The present invention pertains, in general, to butts for rifles, and more specifically, a butt of the type with a support part for the cheek with adjustable position, a part called cheekpiece below.

BACKGROUND OF THE INVENTION

Butts for rifles with a cheekpiece with adjustable position are already known. However, the purpose of the present invention is to provide a butt with a cheekpiece that is adjustable both in height and transversely, with a new system which also makes it possible to easily and comfortably lock the cheekpiece in the desired position, thus adapting the butt to the conditions of sight and aiming of the gun.

SUMMARY OF THE INVENTION

The butt for rifles proposed here essentially consists of a main body and a cheekpiece which is applied in the upper part of said body with the help of means which can be operated with a key and which make possible the movements and the locking in height and transversely of the cheekpiece on and with respect to the body.

BRIEF DESCRIPTION OF THE DRAWINGS

However, greater details of the invention shall become more evident in the course of the description with reference to the attached drawings, which are indicative but not limiting, in which.

DETAILED DESCRIPTION OF THE PREFERRED EMBODIMENT

Figure 1:
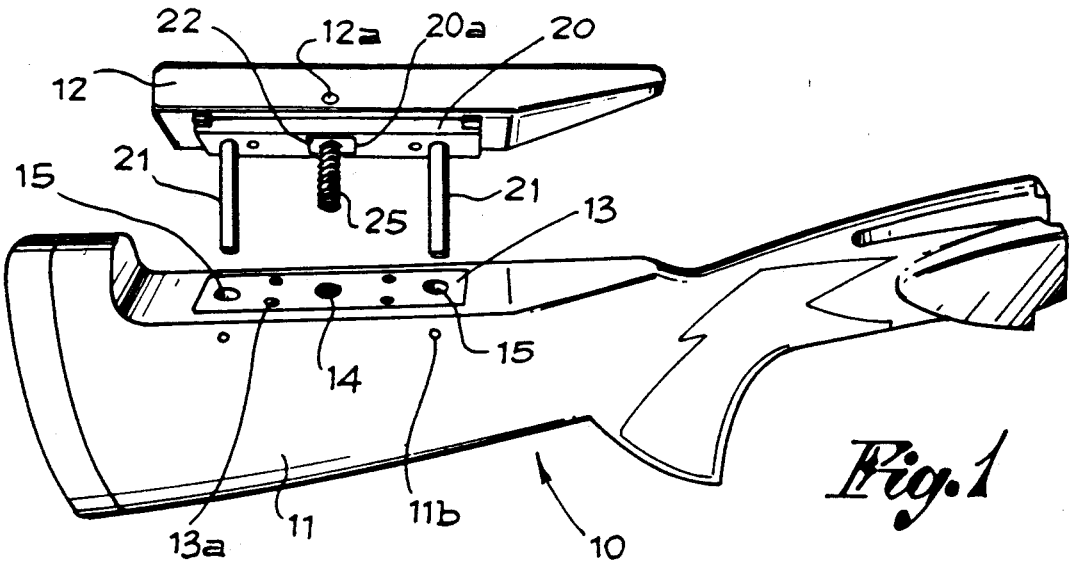
FIG. 1 shows an exploded perspective view of the two essential components of the butt.

In the said drawing, the butt for rifles is generally designated 10 and is formed by a main body 11 and by an inserted, complementary component called a cheekpiece 12, the body and the cheekpiece usually being made of wood. Longitudinally, in its upper part, the body 11 is provided with a hollow, and the cheekpiece 12 is placed in said hollow with the possibility of adjustment in height and in the direction of its width, i.e., transversely.

In the hollow of the body 11 there is attached, by means of screws 13*a*, a metal support 13 provided with a threaded hole 14, in the central position, and with two side holes 15, the holes 14, 15 being defined by bushing parts which are parallel to one another and are parallel with axes extended in the direction of the height of the butt.

Also inserted on the interior face of the cheekpiece 12, by means of screws 16, is a metal component 17 having a central opening 18 and two opposing end tabs which define between themselves a T-seat 19, oriented transversely to the cheekpiece. The component 17 is attached to the cheekpiece and is slide-mounted on a guide plate 20 which is bound to the support 13 on the butt, but with the possibility for adjustments in height as will be explained below.

The plate 20 is coupled in a sliding manner with the T-seat 19 of the component 17 and has a central opening 20*a* in correspondence to the opening of said component 17. Said plate 20 has, screwed into it, two guide bolts 21 intended for being inserted and sliding in the side holes 15 of the support. In the central opening 20*a* of the plate 20 there is attached, by means of pins, a small block 22 having, towards the top, a tab 23 which is extended in the central opening of the component 17 attached to the cheekpiece and, towards the bottom, a T-seat 24.

In this T-seat 24 there is axially engaged, but with the possibility of rotation, the round head 25*a* of a lead screw 25 which is screwed into the central threaded hole 14 of the support 13 and which has on the lower side a polygonal hole accessible from the bottom, through a hole 11*a* in the butt, for applying an instrument, such as a key, for operating the screw 25.

The upper tab 23 of the small block 22 has a transverse hole in which there is inserted a bushing, made of plastic, defining a threaded hole 26 with its axis oriented transversely to the cheekpiece, that is, in parallel to the canal-shaped seat 19 of the component 17. In said threaded hole 26 is screwed a register screw 27 which is held in the central opening 18 with the possibility of rotating, but not of moving axially so as to cause the movement of the component 17 on the plate 20. The screw 27 is accessible for the operation with a key, from the outside, of the cheekpiece 12 through a hole 12*a*.

Essentially, the slide component 17 is attached to the cheekpiece but can be shifted transversely with respect to the guide plate 20 which, in its turn, is only adjustable in height on the body 11 of the butt.

Finally, in the support 13, at the level of the side holes 15, there are made radial holes for threaded screws 28, accessible through holes 11*b* on one side of the butt, for the locking of the bolts 21 in order to prevent sliding into the holes 15 once the positioning of the cheekpiece in height and/or transversely has been executed.

For the positioning in height of the cheekpiece 12 on the main body 11 of the butt, starting from any position, one needs only to loosen the threaded screws 28 so as to unlock the bolts 21 so that they can slide into the relative guide holes 15 of the support 13. Then, one needs only to rotate the central screw 25 with an instrument inserted in the hole 11*a* for shifting the cheekpiece in height towards and away from the body 11. Once this desired position has been reached, it is stabilized by rescrewing the threaded screws 26 for locking the bolts 21.

For a transverse adjustment of the cheekpiece, an adjustment which can be made whatever the position in height of said cheekpiece may be, one needs only to operate the screw 27 for a movement of the slide component 17, together with the cheekpiece, on the guide plate.

Such an adjustment can be made towards the right or towards the left, as desired.

Figure 5:
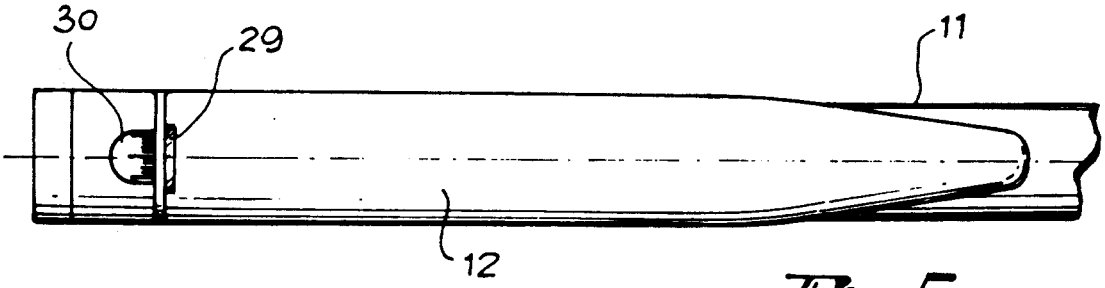
FIGS. 5 and 6 show a top view and a rear view of the assembled butt, respectively.
Figure 2:
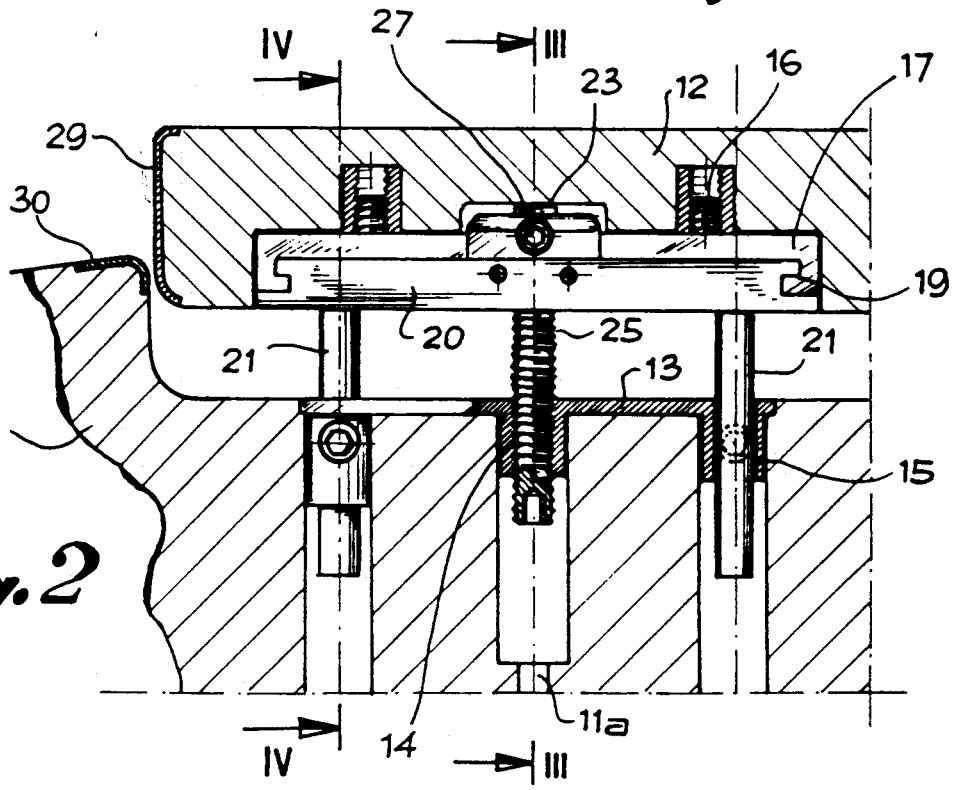
FIG. 2 shows a partial longitudinal section of the assembled butt.
Figure 4:
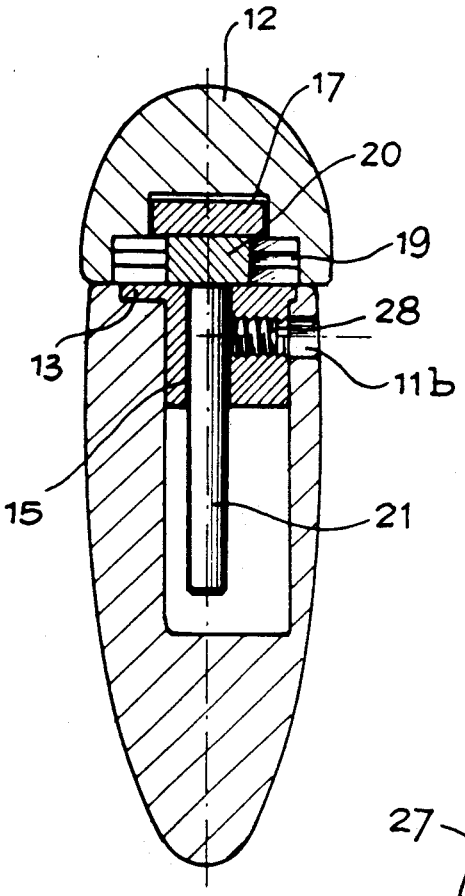
FIG. 4 shows a cross section according to the arrows IV—IV in FIG. 2.
Figure 6:
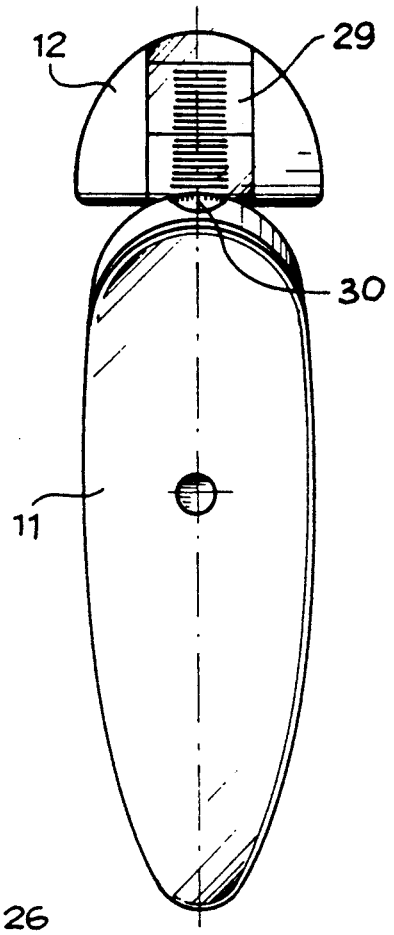
Figure 3:
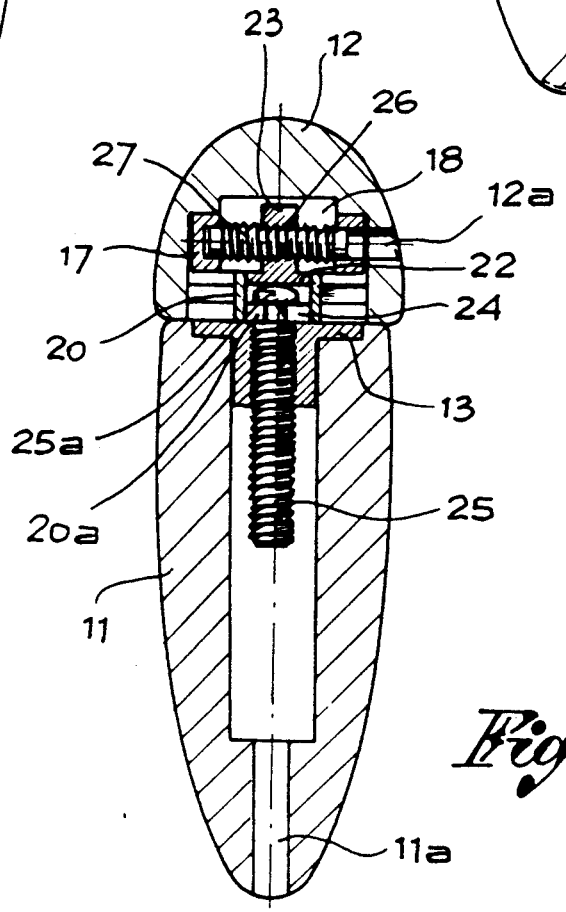
FIG. 3 shows a cross section according to the arrows III—III in FIG. 2.

The adjustments in height and to the sides of the cheekpiece are easily and comfortably carried out with good precision and simply by making use of an instrument for screwing/unscrewing the screws. Calibrated scales 29, 30—cf. FIGS. 5 and 6—inserted in the vertical direction on the back of the cheekpiece and in the transverse direction on the main body, respectively, indicate the positions imposed on the cheekpiece from time to time.

I claim:

1. A butt for rifles, comprising: a main body provided with a top surface with a support having a threaded hole in an intermediate position between two side holes, each of said threaded hole and said two side holes extending in a height direction of said body; a guide plate having two bolts inserted slidably into corresponding said two side holes of said support; a block attached to said guide plate in a central position, said block having a lead screw screwable into said threaded hole for axial movement of said block relative to said threaded hole; a cheek piece including a slide component having a central opening and a canal-shaped seat, said canal-shaped seat being open towards said support and oriented transversely to said cheek piece, said canal-shaped seat of said slide component being coupled in a sliding manner to said guide plate whereby said cheek piece is movable in height upon axial movement of said guide plate; a register screw engaged with said block oriented transversely to said cheek piece and held in said central opening of said slide component in a position fixed relative to said slide component whereby upon rotation of said register screw, said slide component moves with respect to said guide plate for positioning said cheek piece laterally.

2. Butt for rifles according to claim 1, wherein said register screw allows for adjustment of said guide plate for transverse adjustment of said cheek piece regardless of a height position of said guide plate above said support.

3. Butt for rifles according to claim 1, wherein said main body top surface defines a longitudinally extending hollow, each of said cheek piece and said main body having graduate scales for indicating a height and lateral position of said cheek piece with respect to a reference index.

4. Butt for rifles according to claim 1, wherein said block includes a block threaded hole defined by a bushing, said bushing being made of plastic material, said block threaded hole for receiving said register screw.

5. Butt for rifles according to claim 1, wherein said lead screw has a round head coupled to said block for rotation with respect to said block, a through bore being formed in said main body for access to said lead screw; and a through hole formed in one side of said cheek piece for access to said register screw.

6. Butt for rifles according to claim 1, further comprising access holes made in one side of said main body, said bolts being acted on by screws accessible through said access holes for locking said bolts in a position in said side holes.

* * * * *